US005657739A

United States Patent [19]

Smith

[11] Patent Number: 5,657,739

[45] Date of Patent: Aug. 19, 1997

[54] ARCHERY BOW WITH REINFORCED LIMBS

[75] Inventor: Allan F. Smith, Tucson, Ariz.

[73] Assignee: Precision Shooting Equipment, Inc., Tucson, Ariz.

[21] Appl. No.: 575,939

[22] Filed: Dec. 20, 1995

[51] Int. Cl.[6] ..... F41B 5/00

[52] U.S. Cl. ..... 124/23.1; 124/86; 273/DIG. 1; 428/298.1

[58] Field of Search ..... 124/23.1, 25.6, 124/88, 86; 273/DIG. 1, DIG. 7; 428/298.1; 442/179, 264; 444/384

[56] References Cited

U.S. PATENT DOCUMENTS

| | | | |
|---|---|---|---|
| 2,815,015 | 12/1957 | Giacomo | 124/23.1 |
| 2,836,529 | 5/1958 | Morris | 124/23.1 X |
| 2,945,488 | 7/1960 | Cravotta et al. | 124/23.1 |
| 2,966,903 | 1/1961 | Veneko | 124/23.1 |
| 2,980,158 | 4/1961 | Meyer | 124/23.1 X |
| 3,015,327 | 1/1962 | Lightcap | 124/23.1 |
| 3,167,063 | 1/1965 | Kappas | 124/23.1 |
| 3,657,040 | 4/1972 | Shobert | 124/23.1 X |
| 3,659,577 | 5/1972 | Richardson et al. | 124/24 |
| 3,850,156 | 11/1974 | Eicholtz | 124/23.1 |
| 4,324,400 | 4/1982 | Tse | 273/DIG. 7 X |
| 4,460,640 | 7/1984 | Chi et al. | 442/179 X |
| 4,604,319 | 8/1986 | Evans et al. | 442/179 X |
| 4,649,889 | 3/1987 | Johnston | 124/23.1 |
| 4,671,249 | 6/1987 | Troncoso | 124/23.1 |
| 4,712,533 | 12/1987 | Cruise | 273/DIG. 7 X |
| 4,735,667 | 4/1988 | Johnston | 156/175 |
| 5,141,689 | 8/1992 | Simonds | 124/23.1 X |
| 5,307,787 | 5/1994 | LaBorde et al. | 124/25.6 |
| 5,392,756 | 2/1995 | Simonds | 124/23.1 |
| 5,501,208 | 3/1996 | Simonds | 124/86 |
| 5,534,213 | 7/1996 | Epling | 124/23.1 X |

*Primary Examiner*—Randolph A. Reese
*Assistant Examiner*—Thomas A. Beach
*Attorney, Agent, or Firm*—Cahill, Sutton & Thomas P.L.C.

[57] ABSTRACT

A bow limb includes an elongated member having a plurality of strands of glass fiber extending longitudinally within the member and a reinforcing sheet adjacent a major surface of the member, preferably the convex surface of the limb when the limb is flexed. The sheet includes a plurality of carbon fibers that are either unidirectional or bi-directional and, if bi-directional, are woven with the warp of the fibers at an angle to the length of the limb. The angle is adjusted to control the characteristics of the limb.

10 Claims, 2 Drawing Sheets

ARCHERY BOW WITH REINFORCED LIMBS

BACKGROUND OF THE INVENTION

This invention relates to archery bows and, in particular, to an archery bow having molded limbs including a pre-formed reinforcing sheet.

An archery bow is basically a two armed spring having a grip at the middle and held in a flexed or bent position by a string connected to each end of the spring. Energy stored in the bow as it is drawn is transferred to the arrow when the bow is fired. Despite the conceptual simplicity of a bow, actually making a durable, consistent bow has been the work of skilled craftsmen for millennia and continues today.

The simplest bow is made from a single material, typically yew, which is a fine grained, Old World wood used for making cabinets and bows. Even this simple bow requires careful shaping of the yew shaft to control curvature and draw force. Early composite or laminated bows of wood, horn, and sinew provided greater power and durability and permitted the maker to "recurve" the limbs, i.e. to curve the ends of the limbs away from the archer. A recurve bow can be made relatively short from end to end, yet have a long draw, that is, a large distance from the grip on the handle to the nock of the arrow at full draw. A recurve bow also exhibits some "letoff" or reduction in draw force (known as draw weight or simply weight) at full draw, depending upon the motion of the "ears" or the free ends of the limbs. These characteristics of a recurve bow are obtained to an even greater degree in a "compound" bow, in which pulleys replace the ears.

A bow having laminated limbs and a cast metal handle is disclosed in U.S. Pat. No. 3,659,577 (Richardson et al.) The limbs are described as a combination of glass fiber outer layers and wooden veneer inner layers. The limbs are permanently attached to the handle with epoxy adhesive and pins. Although laminated bows made entirely from wood are still made today, a modern bow is typically made in three sections: a central handle or riser and two separate limbs. The handle is typically made from machined aluminum or magnesium. Some limbs are machined from a glass/epoxy laminate or laminated from glass and wood. Some limbs are molded from fiberglass reinforced resin, as described in U.S. Pat. No. 4,735,667 (Johnston).

Bow limbs must withstand large forces resulting from drawing and firing a bow. The problem is more acute in a compound bow in which pulleys are attached to the free ends of the limbs and laced with cable to give an archer a mechanical advantage in drawing the bow. When the pulleys are mounted eccentrically, the pulleys increase the effective length of the limbs at full draw, reducing the required draw force. A reduced draw force at full draw permits the peak draw force of the bow to be increased even more.

As used herein, "lacing" refers either to a one piece bowstring or to a three piece line including two end cables connected by a central stretch between the pulleys which forms the bowstring. The cables and bowstring are not attached to a single point at the end of a bow limb but are spaced across the width of the end of the limb. The substantial forces from the lacing combined with the spacing cause torques on the free ends of the limbs which twist the limbs. The torques vary as the bowstring is drawn and released. In general, the tension on the bowstring is greatest when a bow is at rest and is least when the bow is fully drawn. In the cables, tension is least when the bow is at rest and is greatest when the bow is drawn. As a result of these changing forces, the ends of the limbs twist one way and then the other each time that the bow is drawn and fired. The sideward force from using a finger release and the sideward force from a cable guard pushing the cables to one side also contribute to twisting the limbs as a bow is drawn and fired.

Bows can be made in any weight (peak draw force) that a customer may wish. Limbs of different weights can be made from a single mold by changing the thickness of the limbs. Stiffer limbs are thicker, and somewhat heavier, than limbs that are more easily flexed. The ability of a limb to resist twisting depends primarily upon the stiffness of the limb.

It is desired to separate these two characteristics without unduly complicating the process for making limbs. In particular, it is desired to make a limb that resists twisting but is not so stiff as to produce a bow having a high draw weight. It is also desired to control the stiffness of a limb without increasing the thickness or weight (mass) of the limb.

Custom limbs can be made by producing each limb by its own, unique process. Custom manufacturing using a plurality of different processes and equipment is very costly and impractical. What is desired is the ability to produce bow limbs having wide variety of characteristics, as if the limbs had been made by custom processes, but by using essentially the same process and equipment for all the different types of limbs.

In view of the foregoing, it is therefore an object of the invention to minimize twisting in the tips of the limbs of an archery bow.

Another object of the invention is to make bow limbs with a variety of combinations of characteristics from the same, basic process.

A further object of the invention is to provide a bow limb that has the same stiffness but less mass than a bow limb of the prior art.

Another object of the invention is to control the motion of a bow limb with a pre-formed insert in the limb.

SUMMARY OF THE INVENTION

The foregoing objects are achieved by the invention in which a bow limb includes an elongated member having a plurality of strands of glass fiber extending longitudinally within the member and a reinforcing sheet adjacent a major surface of the member, preferably the convex surface of the limb when the limb is flexed. The sheet includes a plurality of high tensile strength fibers that are either unidirectional or bi-directional and, if bi-directional, are woven with the warp of the fibers at an angle to the length of the limb. The angle is adjusted to control the characteristics of the limb.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
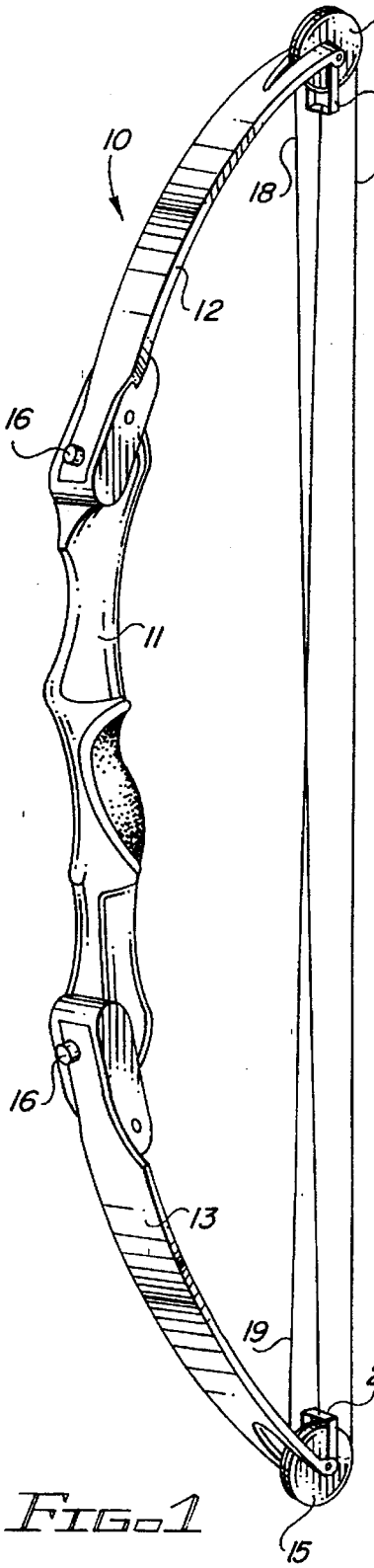
FIG. 1. illustrates the main components of a compound bow.

In FIG. 1, compound bow 10 includes handle 11 having limbs 12 and 13 attached to respective ends of the handle by bolts 16. Pulleys 14 and 15 are mounted on axles attached to the free ends of limbs 12 and 13, respectively. Lacing, including bowstring 17 and cables 18 and 19, interconnect pulleys 14 and 15. Specifically, bowstring 17 has one end connected to cable 18 by way of pulley 15 and the other end connected to cable 19 by pulley 14. The free end of cable 18 is connected to limb 12 by anchor 21. The free end of cable 19 is connected by limb 13 by anchor 22.

As described in the Johnston patent, a limb for a bow is made by wrapping impregnated fiberglass strands around a frame to produce a mass of longitudinal fibers having a predetermined number and having a predetermined volume and weight of plastic resin. The mass of resin and fibers is molded into two limbs attached end to end. The limbs are cut apart and then shaped to accept a limb bolt at one end and an axle and a pulley at the other end. The glass fibers are unidirectional, that is, all the fibers extend generally in the same direction.

Figure 2:
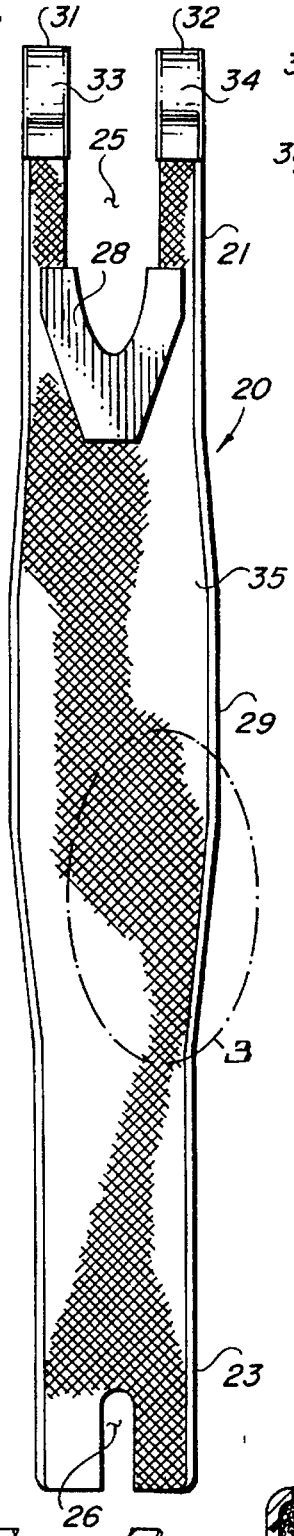
FIG. 2 is a plan view of a limb constructed in accordance with the invention.

FIG. 2 illustrates a limb constructed in accordance with a preferred embodiment the invention in which a reinforcing sheet is molded into the outer or convex surface of the limb. Limb 20 includes free end 21 and butt end 23. Middle 29 preferably has the same cross-sectional area as ends 21 and 23 but is wider and thinner than the ends to assure that limb 20 flexes primarily at the middle.

Slot 25 makes a fork in free end 21 to provide clearance for a pulley (not shown in FIG. 2). Slot 26 in butt end 23 provides clearance for receiving a limb bolt to attach the butt end to one end of a bow handle. Free end 21 also includes reinforcement 28 for preventing splitting of limb 20 as the limb twists. Reinforcements 31 and 32, on the tines of the fork, include holes 33 and 34 for receiving an axle (not shown) about which the pulley rotates.

Figure 3:
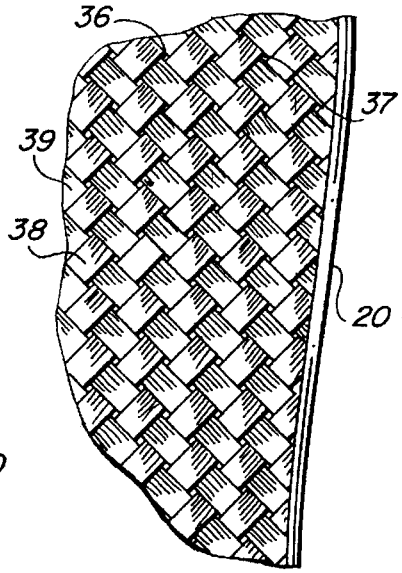
FIG. 3 is a detail from FIG. 2.

The outer or convex surface of limb 20 includes reinforcing sheet 35. FIG. 3 is an enlarged portion of limb 20 showing sheet 35 in greater detail. Sheet 35 is a pre-formed article preferably including bi-directional carbon fibers, that is, carbon fibers extending in two directions and interwoven. The warp of the fibers is preferably at an angle of 45° relative to the length of the limb. As illustrated in FIG. 3, the weave resembles the webbing in a lawn chair in that the weave is slightly open, having a plurality of small gaps at the intersections of the fibers, such as gaps 36 and 37. A plurality of fibers is gathered into flat bundles, such as bundle 38, and woven at right angles with a plurality of other bundles of fiber, such as bundle 39.

As the limb is twisted, the fibers in sheet 35 are subjected to torsional stress that opposes the twist. Depending upon the direction of the twist, either the bundles of fibers having the same orientation as bundle 38 or the bundles of fibers having the same orientation as bundle 39 are subjected to stress. As the limb is flexed, sheet 35 does not affect the stiffness of the limb because the weave is at an angle to the length of the limb and the fibers have less resistance to sideward forces.

In one embodiment of the invention, sheet 35 had a thickness of about 0.030" and the fibers were oriented as shown in FIG. 3. Gaps 36 and 37 were approximately 0.015" square and the bundles of fibers were about 0.065" wide. The carbon fibers had a diameter of about 0.0003", i.e. there were twenty or so fibers per bundle. The bundles were flattened but not necessarily only one fiber thick. The woven fibers were bonded in an epoxy matrix to make a sheet having a monochromatic but iridescent finish that changed in appearance with change in viewing angle and with change in the angle of incident light.

As an example of the operation of a bow limb constructed in accordance with the invention, two limbs constructed as shown in FIGS. 2 and 3 were each mounted at the butt end, subjected to a thirty-five pound load centered within in the fork on an axle at the free end of the limb, and the deflection of the limb was measured. This is referred to as the "bend" test. The limbs were also subjected to a torque by applying the load 1.9 inches from the center of the fork (a torque of 5.54 ft.lbs.) and the deflection of each tine was measured. This is the "twist" test. For comparison, two limbs of the same size but without the reinforcing sheet were subjected to the same tests. The results of the tests are shown in the following table.

TABLE

| | bend test | twist test | |
|---|---|---|---|
| limb | deflection | tine A | tine B |
| carbon-173 | 0.832" | 0.775" | 0.884" |
| regular-173 | 0.842" | 0.762" | 0.897" |
| carbon-157 | 0.842" | 0.781" | 0.895" |
| regular-157 | 0.874" | 0.798" | 0.939" |

As shown by the above Table, the regular-173 limb deflected about one percent more than the similar carbon limb but twisted about twenty-four percent more. The regular-157 limb deflected about four percent more than the similar carbon limb but twisted about twenty-four percent more.

Figure 4:
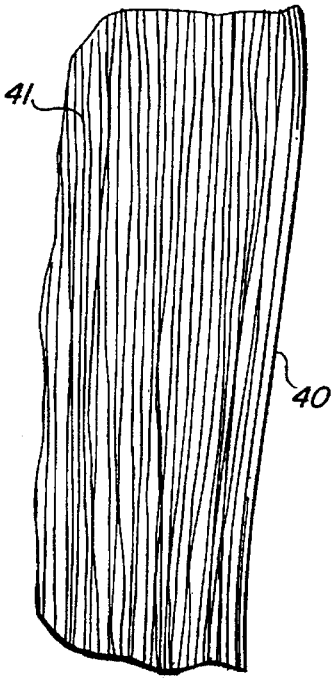
FIG. 4 is a detail illustrating an alternative embodiment of the invention.

Because sheet 35 is a pre-form, limbs having different characteristics can be made using the same process, equipment, and materials. FIG. 4 is a detail of a limb constructed in accordance with an alternative embodiment of the invention. In limb 40, carbon fibers 41 are unidirectional and the fibers extend longitudinally along limb 40. Carbon fibers have a much higher tensile strength than glass fibers, making limb 40 stiffer for its weight (mass) than limbs of the prior art. Although limb 40 resists twist slightly better than a limb without a reinforcing sheet, limb 40 does not resist twist as well as limb 20.

Figure 5:
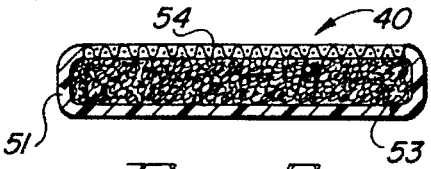
FIG. 5 is a cross-section of a limb constructed in accordance with the invention.

FIG. 5 is a cross-section of limb 40. Limb 40 includes resin jacket 51 surrounding glass fibers 53 and partially surrounding carbon fibers 54. As limb 40 is flexed, jacket 51 and some of glass fibers 53 are subjected to compressive stress while carbon fibers 54 are subjected to tensile stress. The tensile strength of carbon fiber far exceeds the tensile strength of glass fiber, making limb 40 stiffer than a limb made only from glass fiber.

Figures 6, 7, 8:
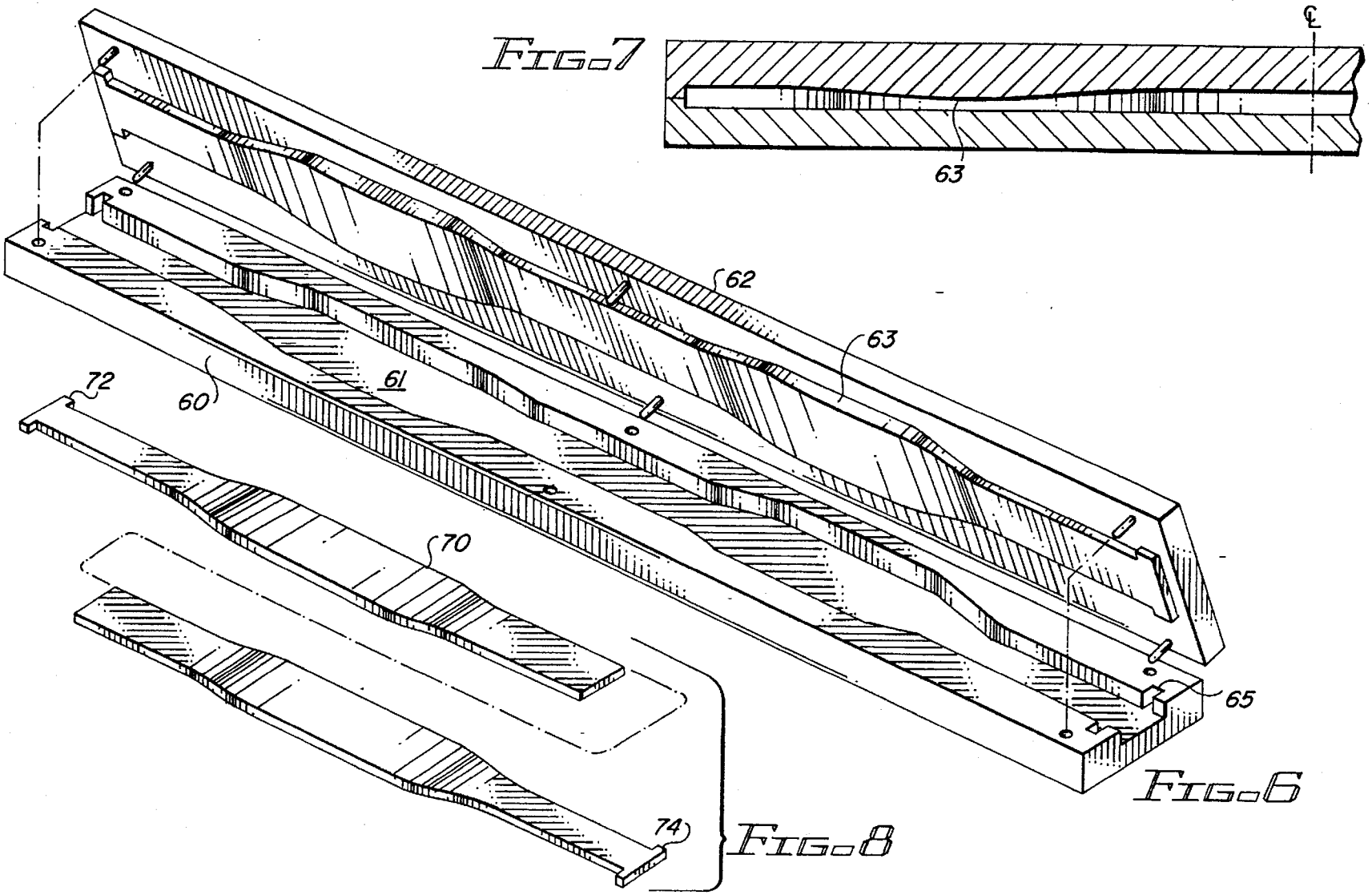
FIG. 6 illustrates a mold for making a limb in accordance with the invention.
FIG. 7 is a cross-section of a mold for making a limb in accordance with the invention.
FIG. 8 is a perspective view of a reinforcing sheet inserted into the mold illustrated in FIG. 7.

FIG. 6 illustrates a mold for making a limb in accordance with the invention. Lower mold 60 includes cavity 61 and upper mold 62 includes protrusion 63. As illustrated in FIG. 7, protrusion 63 has a non uniform thickness to produce a pair of limbs in which the central portion of each limb is wider and thinner than the end portion. It is preferred that a limb have a uniform cross-sectional area along its length.

Lower mold 60 (FIG. 6) also includes a plurality of notches, such as notch 65, for locating a reinforcing sheet within the mold. Reinforcing sheet 70 (FIG. 8) includes tabs, such as tabs 72 and 74, at each end of the sheet for locating the sheet within the mold.

A pair of limbs is made by placing sheet 70 within cavity 61 and then adding resin and glass fibers, as described in the Johnston patent. The inside corners of the mold are radiused to produce the curved corners in each limb, as shown in FIG. 5. After the resin is cured, the limbs are removed from the mold, separated, and notched as shown in FIG. 2. Because of pressure within the mold, a thin coating of resin may overlie the outer surface of the reinforcing sheet but the sheet is substantially at the outer surface of the limb.

A limb constructed in accordance with the invention improves control of the motion of the limbs and the consistency of an archery bow by reducing twisting of the limbs as a bow is drawn and fired. The reinforcing sheet enables one to construct limbs of different characteristics without changing process, equipment, or the other materials used for making the limbs. A reinforcing sheet can be used with presently existing equipment and processes, making it very easy and inexpensive to implement the invention.

Having thus described the invention, it will be apparent to those of skill in the art that modifications can be made within the spirit of the invention. For example, a bi-directional weave can be oriented with one set of bundles parallel to the length of a limb and the other bundles at right angles to the length of the limb. Although resistance to twisting is not increased as much as for the embodiment illustrated in FIG. 3, resistance to splitting is greatly enhanced. Although the reinforcing sheet is described in a preferred embodiment as including carbon fiber, other fibers having a comparable high tensile strength can be used instead, e.g. Kevlar®. The numerical data given above is by way of example only. The number of fibers per bundle, the tightness of the weave, the angle of the weave, the thickness of the fibers, can be changed to produce the desired limb characteristics. A reinforcing sheet can include more than one layer of fibers and the weaves of the layers need not be in the same direction.

What is claimed as the invention is:

1. A limb for a compound archery bow, said limb comprising:

an elongated member having a length between a first end and a second end and having a first major surface, wherein said first major surface is convex when said limb is flexed;

a plurality of strands of glass fiber within said member extending parallel to said length; and a reinforcing sheet of carbon fibers adjacent said first major surface.

2. The limb as set forth in claim 1 wherein said carbon fibers are unidirectional.

3. The limb as set forth in claim 1 wherein said carbon fibers are bi-directional.

4. The limb as set forth in claim 3 wherein said carbon fibers are woven, having a woof and a warp.

5. The limb as set forth in claim 4 wherein the warp of said carbon fibers is at an angle to said length.

6. An archery bow comprising:

a central handle;

a pair of limbs, wherein each limb has one end attached to said handle and a free end;

wherein each limb includes an elongated member having a length between a first end and a second end, a first major surface, a plurality of strands of glass fiber within said member extending parallel to said length, and a reinforcing sheet of carbon fibers adjacent said first major surface, wherein said first major surface is convex when said limb is flexed;

lacing interconnecting said limb.

7. The bow as set forth in claim 6 wherein said carbon fibers are unidirectional.

8. The bow as set forth in the claim 6 wherein said carbon fibers are bi-directional.

9. The bow as set forth in claim 8 wherein said carbon fibers are woven, having a woof and a warp.

10. The bow set forth in claim 9 wherein the warp of said carbon fibers is at an angle to said length.

* * * * *